United States Patent [19]

Gregorian et al.

[11] 4,397,650

[45] Aug. 9, 1983

[54] TEXTILE DYEING PROCESS

[75] Inventors: Razmic S. Gregorian, Aiken; Chettoor G. Namboodri, North Augusta, both of S.C.

[73] Assignee: United Merchants & Manufacturers, Inc., New York, N.Y.

[21] Appl. No.: 287,580

[22] Filed: Jul. 28, 1981

Related U.S. Application Data

[63] Continuation of Ser. No. 943,832, Sep. 19, 1978, abandoned.

[51] Int. Cl.[3] ..... D06P 5/00; D06P 5/02; D06P 3/52; D06P 3/24

[52] U.S. Cl. ..... 8/477; 8/483; 8/485; 8/929

[58] Field of Search ..... 8/477, 483, 485

[56] References Cited

U.S. PATENT DOCUMENTS

| | | | |
|---|---|---|---|
| 2,321,974 | 6/1943 | Bird | 8/478 |
| 2,971,458 | 2/1961 | Kumins et al. | 8/477 |
| 3,762,860 | 10/1973 | Abrahams et al. | 8/929 |
| 3,954,404 | 5/1976 | Childers et al. | 8/929 |
| 3,969,780 | 7/1976 | Henderson | 8/149.1 |
| 3,986,824 | 10/1976 | Waibel et al. | 8/478 |
| 3,990,840 | 10/1975 | Von der Eltz et al. | 8/495 |
| 4,000,964 | 1/1977 | Newton | 8/478 |
| 4,099,913 | 7/1978 | Walter et al. | 8/477 |
| 4,118,526 | 10/1978 | Gregorian et al. | 8/477 |

FOREIGN PATENT DOCUMENTS 853697 8/1977 Belgium .

OTHER PUBLICATIONS

Corbman, B. P., *Textiles: Fiber to Fabric,* McGraw Hill Co., N.Y., 1975, pp. 257–259.

*Primary Examiner*—Maria Parrish Tungol
*Attorney, Agent, or Firm*—Kenyon & Kenyon

[57] ABSTRACT

Disclosed herein is a process for coloring textile materials to produce random dyed effects wherein a coloring material is added to a foamed composition either before or after the foamed composition is coated onto a textile. The foam is then collapsed to penetrate the coloring material into the textile, and, finally, the textile is dried and cured or fixed.

22 Claims, 3 Drawing Figures

10
11
12
13
14
15
16
17
18
19
20

TEXTILE DYEING PROCESS

This is a continuation, of application Ser. No. 943,832 filed Sept. 19, 1978 now abandoned.

BACKGROUND OF THE INVENTION

This invention relates to textile materials, and more particularly, to a process for coloring textile materials to produce random dyed effects.

Our commonly-assigned patent application, U.S. Ser. No. 584,389, now U.S. Pat. No. 4,118,526, describes compositions and processes for treating textile fabric materials with finishing agents such as coloring materials (e.g., dyes, pigments), durable press agents, and the like. In accordance with that invention, such fabric finishing agents are applied in the form of a foamed composition prepared by foaming a mixture of liquid, finishing agent and foaming agent to a blow ratio of about 2:1 to about 20:1. The resultant foamed composition has a density in the range of from about 0.05 gm/cc to about 0.5 gm/cc. The foamed composition is then coated onto a textile, and the foam collapsed, e.g., by padding, compression or application of vacuum or any combination thereof, to penetrate the finishing agent into the textile. The so-treated textile is then dried and cured or fixed in a conventional manner.

The invention of our application Ser. No. 584,389 advantageously decreases the amount of liquid, e.g., water or organic liquid, which is conventionally utilized in the application of finishing agents to textile fabrics. This results in significantly reducing costly liquid removal operations and greatly facilitates the handling and processing of textile fabrics so treated.

The coloring of textiles in accordance with our above-identified application involves the formation of a foam from a composition comprised of coloring material, e.g., dye, pigments, precursors thereof, etc., liquid and a foaming agent, and the application of the foam to a textile to achieve uniform coloration. It is further desirable, however, to produce random dyed effects in textiles, for example, to produce textiles with a faded, tie-dyed, striped or speckled effect.

SUMMARY OF THE INVENTION

It is accordingly an object of the present invention to provide a process, based on the utilization of foamed compositions, which produces random dyed effects on textiles.

According to the present invention, this objective is achieved by provision of a process wherein a foamed composition is prepared by foaming a mixture comprised of liquid and a foaming agent to a blow ratio of from about 2:1 to about 20:1 to form a foam having a density in the range of from about 0.05 gm/cc to about 0.5 gm/cc. A coloring material is then added to the foamed composition either prior or subsequent to application of the foamed composition onto a textile material. The foamed composition on the textile is then collapsed to achieve penetration of the coloring material into the textile and the textile is then dried and cured or fixed.

A wide variety of differing random dyed effects are achievable in accordance with the present invention. Thus, in accordance with one embodiment of the process of this invention, the coloring material is added to the foamed composition, preferably in a drop-wise fashion, with mixing to produce tie dyed effects. In an alternate embodiment, non-uniform mixing of coloring material, preferably added drop-wise, can be utilized to produce faded effects. In a preferred embodiment of this invention, the drop-wise addition of coloring material to the foam is performed at the site at which the foam is being coated onto the textile, either before or after application of the foam on the textile material. The coloring agent may be in either powdered or liquid form and may be either sprayed, dusted or dripped into the foam. For instance, the coloring agent may be introduced into the rolling bank of foam behind the coating knife or after the foam is applied to the fabric. Also, the foamed composition can be uniformly colored, such as for instance as described in our application Ser. No. 584,389, and then a second color added in accordance with the present invention to create a random dyed effect.

In accordance with further specific embodiments of the present invention, the coloring material added to the foamed composition may itself be in the form of a foamable or foamed composition.

As mentioned, the foamed composition to which coloring material is added may itself contain a coloring material. Also, special coloring effects may be obtained with separate color containing foamed compositions. Separate coating of the compositions onto the textile, may, for example, take the form of simultaneously coating each foam in a variegated manner on the textile to produce striped coloring effects, or, alternatively overcoating the textile with each foamed composition.

The random dyeing effects described in this disclosure are not easily achieved by conventional dyeing techniques especially on pile fabrics. For example, if conventional coloring compositions are randomly applied to a pile fabric, the colors quickly run together. On the other hand foams do not readily diffuse into each other. Even after foam collapse the colors do not migrate because there is little carrier (water) on the fabric. On the other hand, if the colors were applied as thickned compositions, the color would reside on the surface and not penetrate down into the fabric. The foams, however, once collapsed, are very fluid and flow down the fibers into the interior of the fabric.

Foamed compositions, and methods for their preparation, for utilization in the process of the present invention are described in detail in our application Ser. No. 584,389 now U.S. Pat. No. 4,118,526, incorporated herein by reference. The preparation of foams from compositions comprised of liquid and foaming agent only will also be apparent from the description in our application Ser. No. 584,389 now U.S. Pat. No. 4,118,526, and the disclosure herein.

As used in the description of the present invention, "coloring material" is intended to include dyes and/or pigments, as well as pre-cursors of such colorants which are reactive with either a component of the textile or of the foamed composition to which they are added.

Textile materials which may be processed according to the present invention include, by way of illustration, fabrics from threads, yarns, tufted, woven or knitted goods, resin bonded mats of fibers, and the like. The process is particularly well adapted to creating novel effects on pile fabrics.

DESCRIPTION OF THE PREFERRED EMBODIMENTS

The process of the present invention, and the various embodiments thereof, are described in more detail with reference to the description of the drawings and the Examples which follow.

Figures 1, 1A:
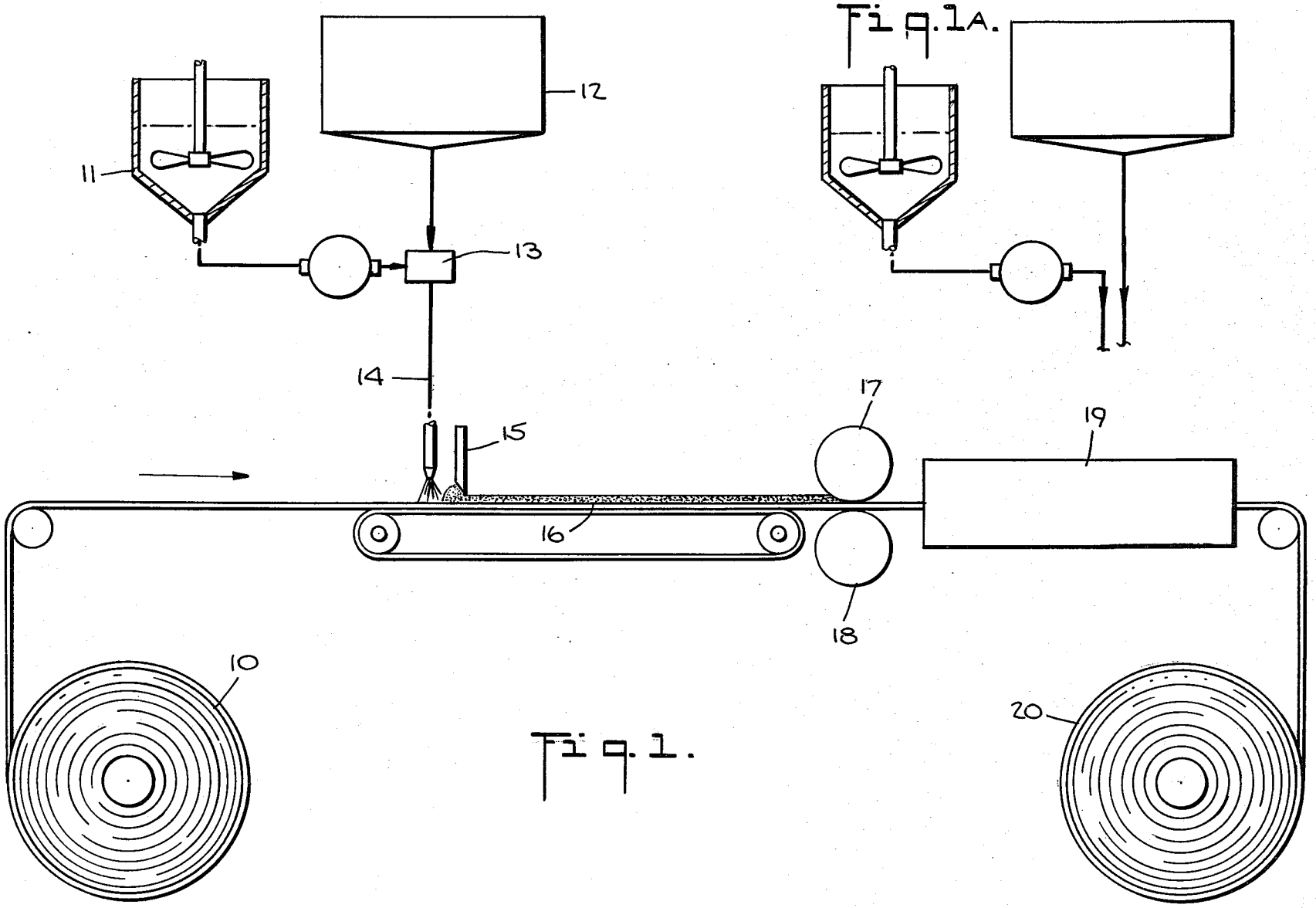
FIGS. 1, 1A and 2 are schematic drawings depicting the manner of applying coloring materials to a textile in accordance with the present invention.

With reference to FIG. 1, a roll of textile fabric 10 is conveyed by suitable means in the direction shown by the arrow to a station wherein it is coated with a foamed composition.

In foamer 11, a foamed composition having a specified blow ratio and density is prepared from a mixture of liquid and a foaming agent. Foamer 11 may be any conventional foamer used in the art, e.g., Oakes, Godwin card, Kitchenaid, etc. The foamed composition is then pumped to mixing station 13 wherein a coloring material from storage vessel 12 is added thereto. As illustrated, the coloring material is injected into pipe 14 with the pipe thus being utilized as a mixer. As an alternative, an in-line static mixer may be incorporated into delivery pipe 14 to provide mixing. The coloring material is injected into the upstream end of the mixer with the degree of mixing being controlled by the number of mixing elements within the static mixer.

The coloring material-containing foamed composition is then transferred through pipe 14 to knife-coating apparatus 15 wherein it is uniformly coated to a predetermined thickness onto the textile. The coating of the foamed composition onto the textile may also be accomplished by spraying or blowing the composition through a jet nozzle.

The coated textile fabric 16 then passes through foam collapsing means, shown as nip rollers 17 and 18 to penetrate the coloring material into the fabric. A vacuum may also be utilized to cause penetration either alone or in conjunction with the nip rolls. The colored fabric is then routed to drying and curing or fixation means 19 and wound on to take-up roll 20.

In an alternate embodiment, shown in FIG. 1A, the coloring material is not fixed with the blank foam composition in mixer 13. Rather, it is added to the bank of foam behind the coating knife at the point at which the foam is coated onto the fabric. Further, the coloring material may be added after knife 15 at a point where the foam is coated onto the fabric. The coloring material may be in powder or liquid form and may be sprayed, dusted or dripped into the foam.

Figure 2:
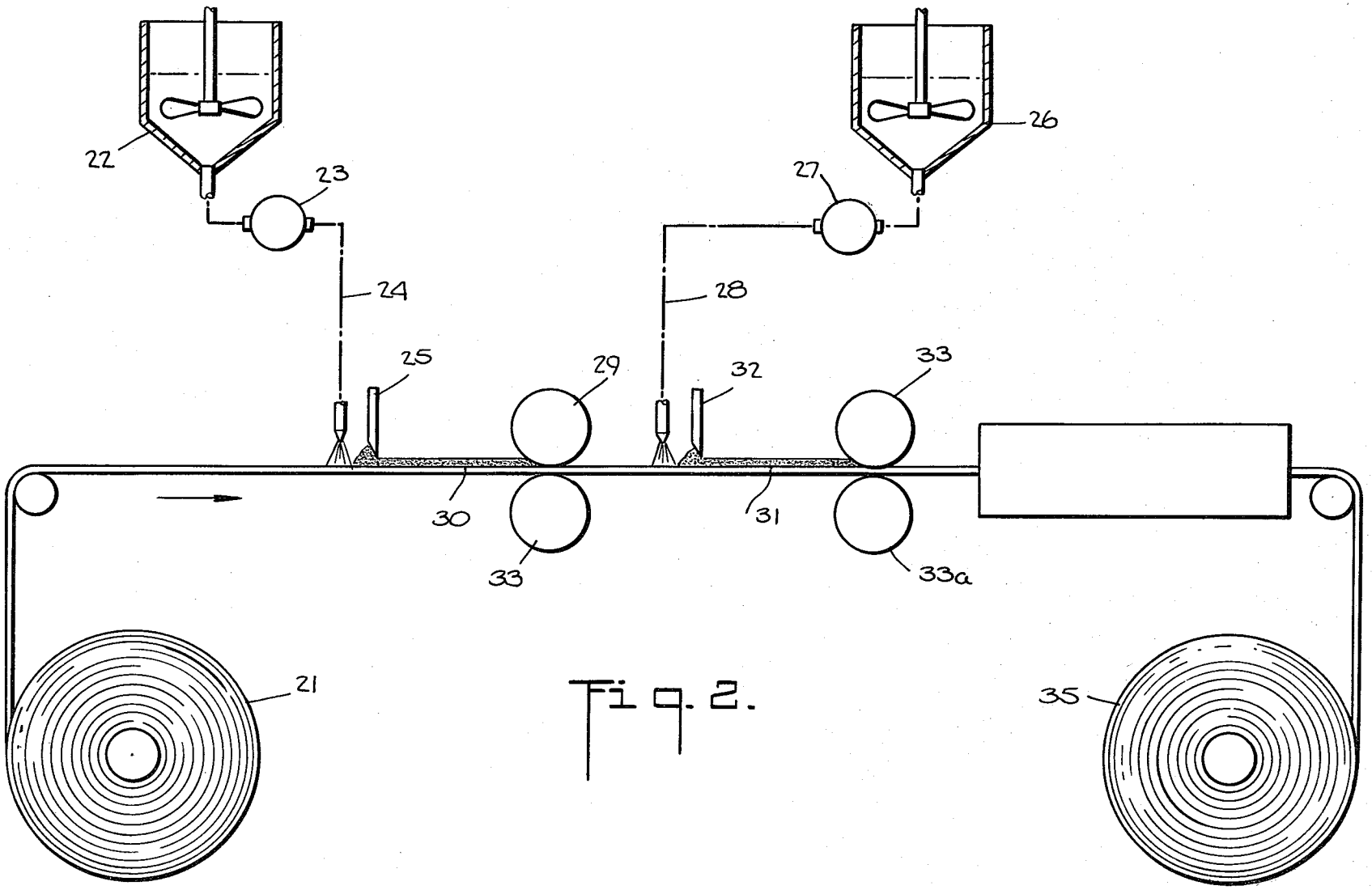

A further embodiment of the invention is shown in FIG. 2. A roll of textile fabric 21 is conveyed in the direction indicated by the arrow to a coating operation. Foamed compositions are prepared, respectively, in foamers 22 and 26 and passed by pumps 23 and 27 through lines 24 and 28 to knife-coating means 25 and 32. As shown in the figure, the textile is first coated with a first foamed composition and the coated textile 30 is then passed through pressure rollers 29 and 33. The textile is then coated with the second foamed composition. The twice-coated textile 31 is then passed through nip rollers 33 and **33*a* to drying and curing or fixation means 34 and wound on to take-up roll 35**. Coloring may be added by the methods discussed previously in conjunction with each application of the foam composition.

In an alternate embodiment, the separate foamed compositions in pipes 24 and 28 are transferred to knife-coating means arranged so as to simultaneously coat the textile in a variegated manner.

The following Examples further illustrate specific details of the present invention.

EXAMPLE I

A foamable composition containing 86.9 parts water, 3.5 parts acrysol ASE-60 (an acrylic polymer emulsion from Rohm & Hass having 28% solids), 0.5 parts ammonia (to pH-9-10), 3.5 parts ammonium stearate (33% solution) and 6 parts Valbond 6063 (low crock from Valchem) was prepared and foamed to a blow ratio of 8:1 to form a non-color containing or blank foam.

To a portion of the blank foam, drops of Questral Blue 2G pigment (phthalocyanine blue pigment dispersion from Roma) were added and swirled together. The color-containing foam was then knife-coated to a thickness of 20 mils on a 50/50 polyester/cotton blend fabric sample and padded. The sample was dried at 220° F. and cured at 300° F. for 5 minutes to obtain tie dyed effects.

To a second portion of the blank foam, drops of Blue 2G pigment were added and mixed into the foam non-uniformly. This foam was then knife-coated to a thickness of 20 mils onto a 50/50 polyester/cotton blend fabric. The fabric was then padded at 30 p.s.i.g., dried at 220° F. and cured at 300° F. for 5 minutes to obtain faded effects.

EXAMPLE II

A composition was prepared by mixing 86.5 parts water, 3.5 parts ASE-60, 0.5 parts ammonia, 3.5 parts ammonium stearate (33%) and 6 parts Valbond-6063 as in Example I and was foamed to a blow ratio of 8:1.

A second composition containing pigment was prepared by mixing 80.5 parts water, 3.5 parts ASE-60, 0.5 parts ammonia, 3.5 parts ammonium stearate (33%), 6 parts Valbond-6063 and 6 parts Questral Blue 2G pigment and was foamed to a blow ratio of 8:1.

A portion of the non-color containing foam and a portion of pigment foam were swirled together and the mixture of foams was knife coated to a thickness of 20 mils on 50/50 polyester/cotton blends samples. The samples were padded at 30 p.s.i.g., dried at 220° F. and cured at 300° F. for 5 min. obtaining random dyed effects.

EXAMPLE III

A composition containing 92.5 parts water, 3.5 parts Acrysol ASE-60, 0.5 parts ammonia and 3.5 parts ammonium stearate (33%) was prepared. Using a small quantity of the composition, disperse dye solutions, one containing 4% Resolin Blue FBL (Disperse Blue-56) and another containing 4% Resolin Red FB (Disperse Red-60), were prepared.

The composition without color was foamed to a blow ratio of 8:1 to obtain a blank foam. To the blank foam a few drops each of the blue and red disperse dye solutions were added and swirled together and 5 mils of the foam was knife coated on a polyester ninon sample, vacuumed and dried. The sample was then thermosoled at 350° F. for 90 sec. obtaining multicolored random dyed effects.

EXAMPLE IV

A disperse dye composition containing 80.5 parts water, 1.5 parts Resolin Blue F.R., 1.5 parts Resolin Brill. Yellow 7GL, 8 parts Acrysol ASE-60, 0.5 parts ammonia, 3 parts potassium stearate (15%) and 5 parts ammonium stearate (33%) was prepared having a pH of 9.9.

A second composition containing 81.5 parts water, 2 parts Resolin Brill. Yellow 7GL, 8 parts ASE-60, 0.5 parts ammonia, 3 parts potassium stearate (15%) and 5 parts ammonium stearate (33%) was also prepared having pH of 10.0.

The latter composition was foamed to a 5:1 blow ratio. A small portion of the former non-foamed green composition was added to the yellow foam and mixed non-uniformly. The mixture was knife coated to a thickness of 300 mils on a polyester sliver knit (having 80% pile weight) pile and the fabric was padded (wet pick-up 41.6%). The sliver knit sample was then dried at 225° F. and thermosoled at 350° F. for 90 sec. obtaining multicolored random dyed effects on the polyester pile.

To produce stripe effects, the two compositions were separately foamed to a 5:1 blow ratio and the two foams were knife coated placing alternatively green and yellow foams side by side on the polyester sliver knit pile. The sample was padded, dried and thermosoled at 350° F. for 90 sec. obtaining green and yellow stripes on the polyester sliver knit pile.

EXAMPLE V

An acid-foamable composition was prepared containing 0.75 parts cellosize QP-52,000 (hydroxyethyl-Cellulose from Union Carbide), 2 parts Unamide N-72-3 (alkanolamide from Lonza Inc.) and 97.25 parts water. The pH was adjusted to 5.5 with acetic acid. The composition was then foamed by air whipping to a 4:1 blow ratio to obtain a blank foam.

A disperse dye mixture in water was prepared, containing 1 part Eastman Polyester Pink RL, 0.5 parts Eastman Polyester Yellow GLSW and 0.5 parts Resolin Blue F.R. disperse dyes in 98 parts water.

Drops of the dye liquor were then added to the blank foam, and mixed non-uniformly. The foam was then knife coated on a polyester sliver knit pile. The sliver knit was then vacuumed from the backing side and padded. This was followed by drying and fixing the color by thermosoling at 350° F. for 90 sec. to obtain random dyed effects on the pile fabric.

EXAMPLE VI

A composition containing 92.5% water, 3.5% ASE-60, 0.5% ammonia and 3.5% ammonium stearate (33% soln.) was foamed using an Oakes Foamer to a 6:1 blow ratio producing a blank or noncolor containing foam. To this blank foam a disperse dye solution (5% Resolin Blue FBL) was fed by injecting the color solution by means of a metering pump into the foam delivery pipe upstream of a static mixer. By non-uniformly mixing the color in the foam (using a minimum number of elements in the static mixer), 15 mil of foam was knife coated on 50/50 polyester/cotton blend fabrics and the fabrics were padded and continuously dried in a range oven at 250° F. On a second portion of the polyester/cotton blend fabric, the foam was knife coated after blending with the color in the static mixer (using more elements) and padded and continuously dried on the range.

Portions of both sections dyed on the range were fixed by steaming and the remaining portions were fixed by thermosoling. Tie dyed effects were produced in portions where the color was less mixed with the blank foam and faded effects were produced when the dye was more completely blended with the blank foam in the static mixer.

EXAMPLE VII

A foamable composition containing an alkaline catalyst was prepared by mixing 89.5 parts water, 1 part soda ash, 1 part sodium bicarbonate, 1 part urea, 3.5 parts Acrysol ASE-60, 0.5 parts ammonia and 3.5 parts ammonium stearate (33% soln.) and foamed to an 8:1 blow ratio.

Three reactive dye solutions were prepared; 5% Remazol Brill. Red FBB soln., 5% Remazol Golden Yellow G-A and 5% Levafix Blue E-BRA. On a rayon flock printed polyester ninon sample, the blank foam was placed at the knife coating station and into the rolling foam bank, the red, blue and yellow reactive dye solutions were dripped and the foam was knife coated to a thickness of 10 mils producing colored stripes. The same procedure was repeated on a rayon flock printed glass fabric. The samples were then vacuumed, dried at 220° F. and steamed at 220° F. for 30 minutes. After steaming, the unfixed reactive dyes were rinsed and soaped off from the polyester and glass portions. The samples were rinsed and dried and were found to possess multicolored dyeing on the rayon flock prints.

EXAMPLE VIII

A foamable composition containing an alkaline catalyst was prepared by mixing 90 parts water, 3.5 parts ASE-60, 0.5 parts ammonia, 2.5 parts potassium stearate (15%), 2.5 parts ammonium stearate (33% soln.) and 1 part caustic soda (50% soln.). The final pH was adjusted to 9.9 with ammonia. The composition was foamed to a 10:1 blow ratio by whipping air into it.

The alkaline foam was placed on rayon flock printed polyester ninon and glass fabric samples and 10 mils was coated while the red, blue and yellow reactive dye solutions (from Example VII) were dripped into the rolling bank of foam producing stripes. The samples were then vacuumed and were cold batched for 3 hours for the fixation of the reactive dye on rayon flock. The samples were then dried at 300° F. for 3 minutes, and rinsed and soaped to remove the unfixed reactive dyes from the samples. The samples were then rinsed and dried, obtaining multicolored rayon flock prints on the polyester ninon and on glass fabrics.

EXAMPLE IX

A random dye effect was applied to a carpet material by an acid dye composition containing 2.2 parts Merpacyl Yellow SL (liq.), 0.25 parts Merpacyl Blue 2GA (liq.), 0.5 parts Merpacyl Red G (liq.) and 97.05 parts of a mix containing 1.5% Unamide N-72-3, 0.75% QP-52,000 and 97.75% water. The composition was foamed using an Oakes Foamer to 8:1 blow ratio.

A 10% solution of Merpacyl Blue 2GA (liq.) was fed by metering a small quantity into the pipe line at a point prior to application onto the fabric. A swirled multicolored foam was produced and knife coated onto a nylon loop carpet pile at 35 mils thickness. The carpet was vacuumed from the backing side and padded. The carpet pile was continuously steamed at 210° F. for 2 minutes and was dried in the oven at 275° F.

A randomly dyed carpet having swirled patter and a multicolor effect was produced by the above method.

EXAMPLE X

An alkaline blank composition containing 2 parts sodium hydroxide (50% soln.) and 98 parts of a mixture containing 3.5% Valthick-70, 0.5 ammonia, 90.5% water and 5.5% ammonium stearate (20% soln.) was prepared. The composition was foamed to 6:1 blow ratio and 25 mils of foam was knife coated n a cotton carpet sample.

On to the coated pile carpet, a Procion Red MX 5B reactive dye powder was sprinkled. The carpet was padded and wet batched for 4 hours and dried. A speckled effect was so produced on the carpet pile.

EXAMPLE XI

A foamable disperse dye composition containing 6 parts disperse Red 60 and 94 parts of a composition which contained 92.5% water, 3.5 ASE-60, 0.5% ammonia and 3.5% ammonium stearate (33%) was prepared. This composition was foamed to 6:1 blow ratio and 150 mils of dye foam was knife coated on a polyester shag carpet pile. The carpet sample was then vacuumed from the backing side and then padded.

A second composition containing 0.5 parts Resolin Yellow 7 GL (Disperse Yellow 93) and 99.5 parts of a composition which contained 3.5 ASE-60 92.5 water, 0.5 ammonia and 3.5 ammonium stearate (33% soln.) was foamed to 3:1 blow ratio. This yellow foam was then tip coated on the polyester shag pile which already had applied thereto a Red disperse dye. (The total wet pick up of shag carpet was now 33% O.W.G.).

The carpet sample was then wet steamed under atmospheric pressure at 210° F. for 15 minutes and dried at 300° F. for 3 minutes for disperse dye fixation.

The carpet shag dyed by this method produced Tak dyed effects and gave satisfactory colorfastness.

EXAMPLE XII

1. Acidic Blank Foam

A composition was prepared by mixing 99.75 parts water, 0.75 parts QP-52,000 and 1.5 parts Unamide N-72-3. The pH was adjusted to 5.5 with acetic acid. The composition was then foamed to a 10:1 blow ratio and 25 mils of the blank foam was knife coated on a nylon 6 loop carpet pile.

A 20% solution of Merpacyl Blue SW (liq.) (Acid Blue 25) was prepared and the solution was dripped in a dotted pattern onto the foam previously applied to the carpet. The carpet was then vacuumed from the back side and steamed at 210° F. for 8 minutes. A blue pattern was produced on the nylon loop carpet pile having good dye penetration inside the pile.

A second sample was foam coated as before and on the coated surface two color patterns were applied by using 20% Merpacyl Blue SW (liq.) solution and 20% solution of Merpacyl Red G (liq.) Acid Red 337. The carpet was then vacuumed from the back side and steamed at 210° F. for 8 minutes. The treatment produced a multicolor pattern on the nylon carpet.

2. Alkaline Blank Foam

A composition was prepared by mixing 90.5 parts water, 3.5 parts Valbond 309-70 (poly acrylic acid type thickner), 0.5 parts ammonia and 5.5 parts ammonium stearate (29% active)-Valfoam 309-59. The pH of the mix was 9.0. The composition was then foamed to 10.1 blow ratio and 25 mils of the blank foam was knife coated on a nylon 6 loop carpet pile.

A 20% solution of Merpacyl Blue SW (liq.) was dripped on the foam applied carpet in a dotted pattern. The carpet was then vacuumed from the backing side and steamed at 210° F. for 8 minutes. A blue pattern was produced on the nylon loop carpet pile having good dye penetration inside pile.

A second sample was foam coated as before and on the coated surface two color patterns were applied by using 20% Merpacyl Blue SW (liq.) and 20% Merpacyl Red G (liq.), solutions. The carpet sample was then vacuumed from the back side and steamed at 210° F. for 8 minutes. The so treated fabric possessed a multicolor pattern on the nylon carpet.

EXAMPLE XIII

A foamable composition was prepared by mixing 3 parts Telon Fast Green 5G and 97 parts of a blank composition for foaming which contained 92.5% water, 3.5% ASE-60, 0.5% ammonia and 3.5% ammonium stearate (33% soln). This composition was foamed to 6:1 blow ratio and 100 mils of dye foam was knife coated on a sample of nylon carpet pile and the carpet was vacuumed from the backing side and padded to obtained uniform color coverage of pile (the wet pick up was 19% O.W.G.).

A foamable composition without a dye and containing 92.5% water 3.5% ASE-60, 0.5% ammonia and 3.5% ammonium stearate (33% soln.) was foamed to 3:1 blow ratio. The foam was printed on the same wet carpet pile which contained the dye, through 50 mesh rotary screen. Then the carpet sample was wet steamed at 210° F. for 8 minutes under atmospheric pressure and dried.

Special cracked ice effects were produced, where the blank foam was printed and the dye was leached down from tips on the green background.

What is claimed is:

1. A method of coloring textile materials, comprising the steps of:

(a) preparing a foamable composition comprised of a liquid and a foaming agent;

(b) foaming said composition to a blow ratio of from about 2:1 to about 20:1 to form a foam having a density in the range of from about 0.05 gm/cc to about 0.5 gm/cc;

(c) applying said foamed composition to a textile material; and (d) collapsing said foamed composition in contact with the textile material, wherein coloring material is added to said foamed composition of step (b) at a point in the method selected from: (1) prior to application of the foamed composition to the textile material; (2) during application of the foamed composition to the textile material; and (3) after application of the foamed composition to the textile material, the collapsing of the foamed composition, containing coloring material, causing penetration of the coloring material into the textile material.

2. The method of claim 1 used to produce a special coloring effect which includes repeating steps (a) through (d) to apply a second foamed composition, each of said foam compositions being coated on to said textile material in a variegated manner.

3. The method of claim 1 to produce a special coloring effect which includes repeating steps (a) through (d) to apply a second foamed composition, and wherein said first foamed composition including a coloring material therein is coated onto the textile material, and thereafter applying to the textile material, having said first foamed composition previously applied thereto, a second foamed composition without any coloring material therein whereby a cracked ice coloring effect is achieved on said textile material.

4. The method of claim 1 used to produce a special coloring effect on a pile type textile material which includes repeating steps (a) through (d) to apply a second foamed composition and wherein each of said foamed compositions is provided with a coloring material therein, said second applied foam composition being applied by tip coating said piles of said textile material in order to produce a tak dyeing effect.

5. A method of coloring textile materials, comprising the steps of:

(a) preparing a foamable composition comprised of a liquid and a foaming agent;

(b) foaming said composition to a blow ratio of from about 2:1 to about 20:1 to form a foam having a density in the range of from about 0.05 gm/cc to about 0.5 gm/cc;

(c) applying said foamed composition to said textile material and thereafter adding a coloring material to said foamed composition; and (d) collapsing said foamed composition containing said coloring material so as to cause penetration of said coloring material into said textile.

6. The method according to claim 5 wherein the so-treated textile resulting from step (d) is thereafter treated to fix the coloring material therein.

7. The method according to claim 5 wherein the coloring material is in the form of a powder, liquid or foam and is sprinkled, sprayed, printed or added drop-wise onto the foamed composition in step (c).

8. The method according to claim 5 wherein said foamable composition of step (a) further comprises a coloring material.

9. The method according to claim 5 wherein the coloring material of step (c) is added to said foamed composition after said foamed composition, applied to said textile material, has been coated to a uniform, predetermined height on the surface of the textile material.

10. A method of coloring textile materials, comprising the steps of:

(a) preparing a foamable composition comprised of a liquid and a foaming agent;

(b) foaming said composition to a blow ratio of from about 2:1 to about 20:1 to form a foam having a density in the range of from about 0.05 gm/cc to about 0.5 gm/cc;

(c) applying said foamed composition to a length of said textile travelling under a coating knife so as to establish a rolling bank of foam behind said coating knife;

(d) adding a coloring material to said bank of foam; and (e) thereafter collapsing said foamed composition containing said coloring material so as to cause penetration of said coloring material into said textile.

11. The method according to claim 10 wherein the textile resulting from step (e) thereafter is treated to fix the coloring material therein.

12. A method of coloring textile materials, comprising the steps of:

(a) preparing a foamable composition comprised of a liquid and a foaming agent;

(b) foaming said composition to a blow ratio of from about 2:1 to about 20:1 to form a foam having a density in the range of from about 0.05 gm/cc to about 0.5 gm/cc;

(c) applying said foamed composition to a length of said textile travelling under a coating knife so as to establish a rolling bank of foam behind said coating knife;

(d) adding a coloring material to said bank of foam;

(e) coating said foam to a substantially uniform, predetermined height on the surface of the textile material; and (f) collapsing said foamed composition containing said coloring material so as to cause penetration of said coloring material into said textile.

13. A method of coloring textile materials, comprising the steps of:

(a) preparing a foamable composition comprised of a liquid and a foaming agent;

(b) foaming said composition to a blow ratio of from about 2:1 to about 20:1 to form a foam having a density in the range of from about 0.05 gm/cc to about 0.5 gm/cc;

(c) applying said foamed composition to said textile material and, during said application, adding a coloring material to said foamed composition; and (d) collapsing said foamed composition containing said coloring material so as to cause penetration of said coloring material into said textile.

14. The method according to claim 13 wherein the so-treated textile resulting from step (d) is thereafter treated to fix the coloring material therein.

15. The method according to claim 13 wherein the coloring material is in the form of a powder, liquid or foam.

16. The method according to claim 15 wherein the coloring material is a liquid and is added drop-wise to the foamed composition in step (c).

17. The method according to claim 13 wherein said foamable composition of step (a) further comprises a coloring material.

18. A method of coloring textile materials, comprising the steps of:

(a) preparing a foamable composition comprised of a liquid and a foaming agent;

(b) foaming said composition to a blow ratio of from about 2:1 to about 20:1 to form a foam having a density in the range of from about 0.05 gm/cc to about 0.5 gm/cc;

(c) adding a coloring material to said foamed composition and applying said foamed composition to a textile material; and (d) collapsing said foamed composition containing said coloring material so as to cause penetration of said coloring material into said textile.

19. The method according to claim 18 wherein said textile resulting from step (d) is thereafter treated to fix the coloring material therein.

20. The method according to claim 18 wherein said coloring material added in step (c) is in the form of a powder or liquid and is sprinkled, sprayed or added drop-wise into the foamed composition.

21. The method according to claim 18 wherein said coloring material added in step (c) is itself in the form of a foamed composition.

22. The method according to claim 18 wherein said foamable composition of step (a) further comprises a coloring material.

* * * * *